US005310640A

United States Patent [19]

Markin et al.

[11] Patent Number: 5,310,640

[45] Date of Patent: May 10, 1994

[54] THERMALL PROCESSABLE IMAGING ELEMENT COMPRISING AN ELECTROCONDUCTIVE LAYER AND A BACKING LAYER

[75] Inventors: Louis J. Markin, Rochester; Diane E. Kestner, Hilton; Wojciech M. Przezdziecki, Pittsford; Peter J. Cowdery-Corvan, Webster, all of N.Y.

[73] Assignee: Eastman Kodak Company, Rochester, N.Y.

[21] Appl. No.: 71,806

[22] Filed: Jun. 2, 1993

[51] Int. Cl.[5] ..... G03C 1/85; G03C 1/76; G03C 1/00

[52] U.S. Cl. ..... 430/527; 430/523; 430/530; 430/536; 430/617; 430/619; 430/950; 430/961

[58] Field of Search ..... 430/523, 527, 530, 536, 430/617, 619, 950, 961

[56] References Cited

U.S. PATENT DOCUMENTS

| | | | |
|---|---|---|---|
| 3,245,833 | 4/1966 | Trevoy | 430/530 |
| 3,933,508 | 1/1976 | Ohkubo et al. | 430/619 |
| 4,120,722 | 10/1978 | Okamoto et al. | 430/619 |
| 4,585,730 | 4/1986 | Cho | 430/523 |
| 4,588,673 | 5/1986 | Kataoka et al. | 430/536 |
| 4,741,992 | 5/1988 | Przezdziecki | 430/523 |
| 4,814,254 | 3/1989 | Naito et al. | 430/203 |
| 4,828,971 | 5/1989 | Przezdziecki | 430/531 |
| 4,857,439 | 8/1989 | Dedio et al. | 430/349 |
| 4,886,739 | 12/1989 | Przezdziecki | 430/617 |
| 4,940,655 | 7/1990 | Gundlach | 430/523 |
| 4,942,115 | 7/1990 | Przezdziecki | 430/523 |
| 4,999,276 | 3/1991 | Kuwabara et al. | 430/530 |
| 5,006,451 | 4/1991 | Anderson et al. | 430/527 |

*Primary Examiner*—Charles L. Bowers, Jr.
*Assistant Examiner*—J. Pasterczyk
*Attorney, Agent, or Firm*—Alfred P. Lorenzo

[57] ABSTRACT

Thermally processable imaging elements in which the image is formed by imagewise heating or by imagewise exposure to light followed by uniform heating are provided with both a backing layer and an electroconductive layer to reduce static electricity effects and improve conveyance through processing equipment. The backing layer is an outermost layer and is located on the side of the support opposite to the imaging layer whereas the electroconductive layer is an inner layer and can be disposed on either side of the support.

15 Claims, No Drawings

THERMALL PROCESSABLE IMAGING ELEMENT COMPRISING AN ELECTROCONDUCTIVE LAYER AND A BACKING LAYER

FIELD OF THE INVENTION

This invention relates in general to imaging elements and in particular to thermally processable imaging elements. More specifically, this invention relates to imaging elements comprising a thermographic or photothermographic layer, an electroconductive layer and a backing layer.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure,* June 1978, Item No. 17029 and U.S. Pat. Nos. 3,080,254, 3,457,075 and 3,933,508.

The aforesaid thermally processable imaging elements are often provided with an overcoat layer and/or a backing layer, with the overcoat layer being the outermost layer on the side of the support on which the imaging layer is coated and the backing layer being the outermost layer on the opposite side of the support. Other layers which are advantageously incorporated in thermally processable imaging elements include subbing layers and barrier layers.

To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A backing layer also serves several important functions which improve the overall performance of thermally processable imaging elements. For example, a backing layer serves to improve conveyance, reduce static electricity and eliminate formation of Newton Rings.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the as described in U.S. Pat. No. 4,828,971, issued May 9, 1989.

One of the most difficult problems involved in the manufacture of thermally processable imaging elements is that the protective overcoat layer typically does not exhibit adequate adhesion to the imaging layer. The problem of achieving adequate adhesion is particularly aggravated by the fact that the imaging layer is typically hydrophobic while the overcoat layer is typically hydrophilic. One solution to this problem is that described in U.S. Pat. No. 4,886,739, issued Dec. 12, 1989, in which a polyalkoxysilane is added to the thermographic or photothermographic imaging composition and is hydrolyzed in situ to form an $R_xSi(OH)_{4-x}$ moiety which has the ability to crosslink with binders present in the imaging layer and the overcoat layer. Another solution to the problem is that described in U.S. Pat. No. 4,942,115, issued Jul. 17, 1990, in which an adhesion-promoting layer, in particular a layer composed of an adhesion-promoting terpolymer, is interposed between the imaging layer and the overcoat layer.

U.S. Pat. No. 4,828,971 explains the requirements for backing layers in thermally processable imaging elements. It points out that an optimum backing layer must:

(a) provide adequate conveyance characteristics during manufacturing steps, (b) provide resistance to deformation of the element during thermal processing, (c) enable satisfactory adhesion of the backing layer to the support of the element without undesired removal during thermal processing, (d) be free from cracking and undesired marking, such as abrasion marking during manufacture, storage and processing of the element, (e) reduce static electricity effects during manufacture and (f) not provide undesired sensitometric effects in the element during manufacture, storage or processing.

To meet all of these requirements with a single layer has proven to be extraordinarily difficult. While the backing layer of the '971 patent has excellent performance characteristics, its electrical conductivity is highly dependent on humidity. Under the very low humidity conditions involved in the high temperature processing chambers employed with thermally processable imaging elements, its conductivity is much too low to provide good protection against the effects of static. One of the adverse effects of static buildup is poor transport through processing equipment. In the present invention, separate backing and electroconductive layers are provided to more effectively meet the needs of this art, and particularly to enhance transport characteristics while retaining all other desirable properties.

SUMMARY OF THE INVENTION

In accordance with this invention, a thermally processable imaging element is comprised of:

(1) a support;

(2) a thermographic or photothermographic imaging layer on one side of the support;

(3) a backing layer which is an outermost layer and is located on the side of the support opposite to the imaging layer, the backing layer comprising a binder and a matting agent dispersed therein; and (4) an electroconductive layer which is an inner layer and is located on either side of the support, the electroconductive layer having an internal resistivity of less than $5\times10^{10}$ ohms/square.

In terms of layer arrangement, a number of different formats are suitable for the thermally processable imaging element of this invention. The essential layers are the imaging layer, the electroconductive layer and the backing layer. Optional layers include subbing layers, barrier layers and overcoat layers. More than one subbing layer or barrier layer can be utilized and both overcoat layers and/or backing layers made up of two or more layers can be employed.

Suitable layer arrangements in this invention include:

(A) an element comprising a support having a backing layer on one side thereof and having, in order, on the opposite side an electroconductive layer and an imaging layer;

(B) an element comprising a support having a backing layer on one side thereof and having, in order, on the opposite side an electroconductive layer, an imaging layer and an overcoat layer;

(C) an element comprising a support having a backing layer on one side thereof and having, in order, on the opposite side, a subbing layer, an electroconductive layer, an imaging layer and an overcoat layer;

(D) an element comprising a support having a backing layer on one side thereof and having, in order, on the opposite side a subbing layer, an electroconductive layer, a barrier layer, an imaging layer and an overcoat layer;

(E) an element comprising a support having, in order, on one side thereof an electroconductive layer and a backing layer and having on the opposite side an imaging layer;

(F) an element comprising a support having, in order, on one side thereof an electroconductive layer and a backing layer and having on the opposite side, in order, an imaging layer and an overcoat layer;

(G) an element comprising a support having, in order, on one side thereof an electroconductive layer and a backing layer and having on the opposite side, in order, a subbing layer, an imaging layer and an overcoat layer.

Backing layers which are compatible with the requirments of thermally processable imaging elements are known in the art and are described, for example, in U.S. Pat. No. 4,828,971. However, by themselves backing layers are less than fully effective in meeting the stringent requirements of this art. By including both a backing layer and an electroconductive layer with an internal resistivity of less than $5\times10^{10}$ ohms/square, it has been found to be feasible to simultaneously meet all of the desired attributes for a thermally processable imaging element.

DESCRIPTION OF THE PREFERRED EMBODIMENTS

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure,* June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. Nos. 3,933,508, 3,801,321 and *Research Disclosure,* June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure,* June 1978, Item No. 17029.

The thermally processable element can comprise a variety of supports. Examples of useful supports are poly(vinylacetal) film, polystyrene film, poly(ethyleneterephthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

As hereinabove described, the thermally processable imaging element of this invention includes both a backing layer and an electroconductive layer.

The backing layer utilized in this invention is an outermost layer and is located on the side of the support opposite to the imaging layer. It is comprised of a binder and a matting agent which is dispersed in the binder in an amount sufficient to provide the desired surface roughness.

A wide variety of materials can be used to prepare a backing layer that is compatible with the requirements of thermally processable imaging elements. The backing layer should be transparent and colorless and should not adversely affect sensitometric characteristics of the photothermographic element such as minimum density, maximum density and photographic speed. Preferred backing layers are those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from polymethylmethacrylate, cellulose acetate, crosslinked polyvinyl alcohol, terpolymers of acrylonitrile, vinylidene chloride, and 2-(methacryloyloxy)ethyltrimethylammonium methosulfate, crosslinked gelatin, polyesters and polyurethanes.

In the thermally processable imaging elements of this invention, either organic or inorganic matting agents can be used. Examples of organic matting agents are particles, often in the form of beads, of polymers such as polymeric esters of acrylic and methacrylic acid, e.g., poly(methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The backing layer preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5.

As described in U.S. Pat. No. 4,828,971, the Roughness Average (Ra) is the arithmetic average of all departures of the roughness profile from the mean line.

The concentration of matting agent required to give the desired roughness depends on the mean diameter of the particles and the amount of binder. Preferred particles are those with a mean diameter of from about 1 to about 15 micrometers, preferably from 2 to 8 micrometers. The matte particles can be usefully employed at a concentration of about 1 to about 100 milligrams per square meter.

The electroconductive layer utilized in this invention is an "inner layer", i.e., a layer located under one or more overlying layers. It can be disposed on either side of the support. As indicated hereinabove, it has an internal resistivity of less than $5\times10^{10}$ ohms/square. Preferably, the internal resistivity of the electroconductive layer is less than $1\times10^{10}$ ohms/square.

The electroconductive layer can be composed of any of a very wide variety of compositions which are capable of forming a layer with suitable physical and electrical properties to be compatible with the requirements of thermally processable imaging elements. Included among the useful electroconductive layers are:

(1) Electroconductive layers comprised of electrically-conductive metal-containing particles dispersed in a polymeric binder. Examples of useful electrically-conductive metal-containing particles include donor-doped metal oxide, metal oxides containing oxygen deficiencies and conductive nitrides, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN and ZrC.

Examples of the many patents describing electrically-conductive metal-containing particles that are useful in this invention include:

(a) semiconductive metal salts such as cuprous iodide as described in U.S. Pat. Nos. 3,245,833, 3,428,451 and 5,075,171;

(b) metal oxides, preferably antimony-doped tin oxide, aluminum-doped zinc oxide and niobium-doped titanium oxide as described in U.S. Pat. Nos. 4,275,103, 4,394,441, 4,416,963, 4,418,141, 4,431,764, 4,495,276, 4,571,361, 4,999,276 and 5,122,445;

(c) a colloidal gel of vanadium pentoxide as described in U.S. Pat. Nos. 4,203,769 and 5,006,451;

(d) fibrous conductive powders comprising, for example, antimony-doped tin oxide coated onto non-conductive potassium titanate whiskers as described in U.S. Pat. Nos. 4,845,369 and 5,116,666;

(e) electroconductive ceramic particles, such as particles of TiN, $NbB_2$, TiC, $LaB_6$ or MoB dispersed in a binder as described in Japanese KOKAI NO. 4/55492, published Feb. 24, 1992;

(2) Electroconductive layers composed of a vapor-deposited metal such as silver, aluminum or nickel;

(3) Electroconductive layers composed of binderless electrically-semiconductive metal oxide thin films formed by oxidation of vapor-deposited metal films as described in U.S. Pat. No. 4,078,935.

(4) Electroconductive layers composed of conductive polymers such as, for example, the crosslinked vinylbenzyl quaternary ammonium polymers of U.S. Pat. No. 4,070,189 or the conductive polyanilines of U.S. Pat. No. 4,237,194.

A colloidal gel of vanadium pentoxide is especially useful for forming the electroconductive layer. When vanadium pentoxide is used for this purpose, it is desirable to interpose a barrier layer between the electroconductive layer and the imaging layer so as to inhibit migration of vanadium pentoxide from the electroconductive layer into the imaging layer with resulting adverse sensitometric affects. Suitable barrier layers include those having the same composition as the backing layer of U.S. Pat. No. 4,828,971, namely, a mixture of poly(silicic acid) and a water-soluble hydroxyl-containing monomer or polymer.

Use in this invention of a colloidal gel of vanadium pentoxide, the preparation of which is described in U.S. Pat. No. 4,203,769, issued May 20, 1980, has many important beneficial advantages. The colloidal vanadium pentoxide gel typically consists of entangled, high aspect ratio, flat ribbons about 50–100 Ångstroms wide, about 10 Ångstroms thick and about 1000–10000 Ångstroms long. The ribbons stack flat in the direction parallel to the surface when the gel is coated to form a conductive layer. The result is very high electrical conductivities which are typically about three orders of magnitude greater than is observed for layers of similar thickness containing crystalline vanadium pentoxide particles. Low surface resistivities can be obtained with very low vanadium pentoxide coverages. This results in low optical absorption and scattering losses. Also, the coating containing the colloidal vanadium pentoxide gel is highly adherent to underlying support materials.

Typically, the thermally processable imaging elements of this invention include an overcoat layer. The overcoat layer performs several important functions as hereinabove described. It can be composed of hydrophilic colloids such as gelatin or poly(vinyl alcohol) but is preferably composed of poly(silicic acid) and a water-soluble hydroxyl-containing monomer or polymer as described in U.S. Pat. No. 4,741,992, issued May 3, 1988.

Subbing layers can also be included in the thermally processable imaging elements of this invention. Particularly useful subbing layers are the polymeric adhesion-promoting layers described in U.S. Pat. 4,942,115, issued Jul. 17, 1990. As disclosed in the '115 patent, preferred adhesion-promoters are terpolymers of 2-propenenitrile, 1,1-dichloroethylene and propenoic acid and terpolymers of the methyl ester of 2-propenoic acid, 1,1-dichloroethylene and itaconic acid.

Thicknesses for the various layers utilized in the thermally processable imaging elements of this invention can be widely varied as desired. Representative dry thicknesses are from about 0.1 to about 2 micrometers for the backing layer, from about 0.01 to about 1 micrometers for the electroconductive layer, from about 0.5 to about 3 micrometers for the barrier layer, from about 1 to about 12 micrometers for the imaging layer and from about 1 to about 10 micrometers for the overcoat layer.

The invention is further illustrated by the following examples of its practice. For purposes of comparison, a control element, which lacked an electroconductive layer, was also prepared and evaluated.

CONTROL ELEMENT

A thermally-processable imaging element was prepared using a 0.1 millimeter thick polyethylene terephthalate film, subbed on both sides, as a support. The subbed polyethylene terephthalate film was coated on one side with a backing layer having a dry thickness of 0.5 micrometers and on its opposite side, in order, with an imaging layer having a dry thickness of 9 micrometers and an overcoat layer having a dry thickness of 2 micrometers. The composition of the backing layer, imaging layer and overcoat layer was the same as that described for element B in Example 1 of U.S. Pat. No. 4,828,971.

Both the control element and the elements of the following examples were tested with respect to free charge, internal resistivity, propensity to dusting, blue $D_{min}$ and surface roughness. To obtain the value for free charge, which is specified in volts, the element was exposed and processed in the conventional manner and the measurement was made with a MONROE FIELD METER with the probe positioned about 2.5 centimeters from the surface of the element. Internal resistivity was measured by the salt bridge method and is reported in ohms per square. To evaluate propensity to dusting, the element is subjected to a specified load and the backing layer is drawn across a rough black interleaving paper. The amount of matte particles that transfer to the paper is rated relative to a standard, with a rating of 1 being the best and a rating of 4 being the worst. To determine whether the sensitometric characteristics of the film are acceptable, the Status A blue $D_{min}$ level was measured after thermal processing. To determine the ability of the element to resist the formation of Newton rings, the Roughness Average (Ra) value was determined using a GOULD MICRO-TOPOGRAPHER 200 surface analyzer.

EXAMPLE 1

A thermally-processable imaging element was prepared that was the same as the control element except that an electroconductive layer was interposed between the support and the backing layer. The electroconductive layer was a vacuum-deposited nickel layer with a thickness of 0.01 micrometers.

EXAMPLE 2

A thermally-processable imaging element was prepared that was the same as the control element except that the backing layer was composed of polymethylmethacrylate and an electroconductive layer was interposed between the support and the backing layer. The backing layer contained, as a matting agent, beads of poly(methylmethacrylate-coethyleneglycoldimethacrylate) with a particle size of 3 to 4 micrometers at a coverage of 25 mg/m$^2$. The electroconductive layer had a thickness of 0.02 micrometers and was composed of a colloidal gel of silver-doped vanadium pentoxide dispersed in a polymeric binder.

EXAMPLE 3

A thermally-processable imaging element was prepared that was the same as the control element except that an electroconductive layer was interposed between the support and the imaging layer. The electroconductive layer was composed of cuprous iodide dispersed in a polymeric binder.

EXAMPLE 4

A thermally-processable imaging element was prepared that was the same as the control element except that an electroconductive layer was interposed between the support and the imaging layer. The electroconductive layer was a vacuum-deposited nickel layer with a thickness of 0.01 micrometers.

EXAMPLE 5

A thermally-processable imaging element was prepared that was the same as the control element except that an electroconductive layer was interposed between the support and the imaging layer. The electroconductive layer had a thickness of 0.02 micrometers and was composed of a colloidal gel of silver-doped vanadium pentoxide dispersed in a polymeric binder.

EXAMPLE 6

A thermally-processable imaging element was prepared using a 0.1 millimeter thick polyethylene terephthalate film, subbed on both sides, as a support. The subbed polyethylene terephthalate film was coated on one side with a backing layer and on its opposite side, in order, with an electroconductive layer, a barrier layer, an imaging layer and an overcoat layer. The backing layer, imaging layer and overcoat layer were the same as those of the control element. The barrier layer was composed of a mixture of poly(silicic acid) and poly(vinyl alcohol) and had a dry thickness of 0.2 micrometers. The electroconductive layer had a thickness of 0.02 micrometers and was composed of a colloidal gel of silver-doped vanadium pentoxide dispersed in a polymeric binder.

Results obtained with the control element and with the elements of each of Examples 1 to 6 are summarized in Table I below.

TABLE I

| Element | Free Charge (volts | Internal Resistivity (ohms/square) | Dusting Severity | Blue $D_{min}$ | Ra (micro-inches) |
|---|---|---|---|---|---|
| Control | 6000 | $4.3 \times 10^{11}$ | 4 | 0.14 | 0.9 |
| Example 1 | 50 | $1.0 \times 10^{9}$ | 4 | 0.42 | 0.9 |
| Example 2 | 0 | $1.0 \times 10^{9}$ | 1 | 0.12 | 1.6 |
| Example 3 | 0 | $2.9 \times 10^{10}$ | 4 | — | 0.9 |
| Example 4 | 0 | — | | | |

As indicated by the data in Table I above, the thermally-processable imaging elements of this invention, which employ both a backing layer and an electroconductive layer, provide greatly reduced free charge and much lower internal resistivity than the control element which lacked the electroconductive layer. Additionally, the elements of this invention provide acceptable characteristics with respect to dusting, blue $D_{min}$ and surface roughness. The data reported in Table I also indicate that acceptable results can be achieved by placing the electroconductive layer on the same side of the support as the imaging layer or on the opposite side of the support from the imaging layer.

To meet all of the stringent requirements of the photothermographic art with just a backing layer has proven to be impractical. In accordance with this invention, both a backing layer and an electroconductive layer are provided and the two layers function in combination to provide all of the desired features. The electroconductive layer can be positioned on either side of the support so that considerable flexibility exists in regard to the specific layer arrangement utilized.

The invention has been described in detail, with particular reference to certain preferred embodiments thereof, but it should be understood that variations and modifications can be effected within the spirit and scope of the invention.

We claim:

1. A thermally processable imaging element, said element comprising:

(1) a support;

(2) a thermographic or photothermographic imaging layer on one side of said support;

(3) a backing layer which is an outermost layer and is located on the side of said support opposite to said imaging layer, said backing layer comprising a binder and a matting agent dispersed therein; and (4) an electroconductive layer which is an inner layer and is located on either side of said support, said electroconductive layer having an internal resistivity of less than $5 \times 10^{10}$ ohms/square.

2. A thermally processable imaging element as claimed in claim 1, wherein said support is a poly(ethylene terephthalate) film.

3. A thermally processable imaging element as claimed in claim 1 wherein said imaging layer comprises:

(a) photographic silver halide, (b) an image-forming combination comprising (i) an organic silver salt oxidizing agent, with (ii) a reducing agent for the organic silver salt oxidizing agent, and (c) a toning agent.

4. A thermally processable imaging element as claimed in claim 1, wherein said imaging layer comprises:

(a) photographic silver halide, (b) an image-forming combination comprising (i) silver behenate, with (ii) a phenolic reducing agent for the silver behenate, (c) a succinimide toning agent, and (d) an image stabilizer.

5. A thermally processable imaging element as claimed in claim 1, wherein said backing layer is comprised of poly(silicic acid).

6. A thermally processable imaging element as claimed in claim 1, wherein said backing layer is comprised of poly(silicic acid) and poly(vinyl alcohol).

7. A thermally processable imaging element as claimed in claim 1, wherein said backing layer is a polymethylmethacrylate layer.

8. A thermally processable imaging element as claimed in claim 1, wherein said electroconductive layer has an internal resistivity of less than $1 \times 10^{10}$ ohms/square.

9. A thermally processable imaging element as claimed in claim 1, wherein said electroconductive layer is a nickel layer.

10. A thermally processable imaging element as claimed in claim 1, wherein said electroconductive layer comprises cuprous iodide.

11. A thermally processable imaging element as claimed in claim 1, wherein said electroconductive layer comprises a colloidal gel of vanadium pentoxide.

12. A thermally processable imaging element, said element comprising:

(1) a support;

(2) a thermographic or photothermographic imaging layer on one side of said support;

(3) an overcoat layer overlying said imaging layer;

(4) a backing layer which is an outermost layer and is located on the side of said support opposite to said imaging layer, said backing layer comprising a binder and a matting agent dispersed therein; and (5) an electroconductive layer interposed between said support and said backing layer, said electroconductive layer having an internal resistivity of less than $5\times10^{10}$ ohms/square.

13. A thermally processable imaging element as claimed in claim 12, wherein said overcoat layer is comprised of poly(silicic acid) and poly(vinyl alcohol).

14. A thermally processable imaging element, said element comprising:

(1) a support;

(2) a thermographic or photothermographic imaging layer on one side of said support;

(3) an overcoat layer overlying said imaging layer;

(4) a backing layer which is an outermost layer and is located on the side of said support opposite to said imaging layer, said backing layer comprising a binder and a matting agent dispersed therein; and (5) an electroconductive layer interposed between said support and said backing layer, said electroconductive layer having an internal resistivity of less than $5\times10^{10}$ ohms/square.

15. A thermally processable imaging element as claimed in claim 14, wherein said overcoat layer is comprised of poly(silicic acid) and poly(vinyl alcohol).

* * * * *